United States Patent [19]

Schwartz

[11] Patent Number: 4,713,874

[45] Date of Patent: Dec. 22, 1987

[54] TELEPHONE WIRE-AND-JACK ATTACHMENT DEVICE AND KIT

[75] Inventor: Frederic W. Schwartz, Providence, R.I.

[73] Assignee: Cable Electric Products, Inc., Providence, R.I.

[21] Appl. No.: 880,463

[22] Filed: Jun. 30, 1986

Related U.S. Application Data

[63] Continuation of Ser. No. 780,760, Sep. 27, 1985, abandoned.

[51] Int. Cl.[4] ..... H01R 43/04

[52] U.S. Cl. ..... 29/566.4; 7/131; 29/751

[58] Field of Search ..... 29/566.4, 33 M, 750, 29/751, 752; 7/107, 131

[56] References Cited

U.S. PATENT DOCUMENTS

| | | | |
|---|---|---|---|
| 3,940,838 | 3/1976 | Cryctco | 29/751 |
| 4,083,105 | 4/1978 | ViPond | 7/107 X |
| 4,429,451 | 2/1984 | Angelico | 29/566.4 |
| 4,480,374 | 11/1984 | Meyer | 29/566.4 |

FOREIGN PATENT DOCUMENTS

| | | | |
|---|---|---|---|
| 2398580 | 3/1979 | France | 29/751 |

*Primary Examiner*—Z. R. Bilinsky

*Attorney, Agent, or Firm*—Paul J. Sutton

[57] ABSTRACT

The invention features a kit for connecting telephone wire to a modular jack connector. The kit comprises a tool that cuts and strips the wire, as well as mechanically bonds and electrically connects the cut and stripped wire to the jack connector. A quantity of modular jack connectors are provided in the kit, which has a housing containing the tool and connectors.

5 Claims, 17 Drawing Figures

FIG. 4
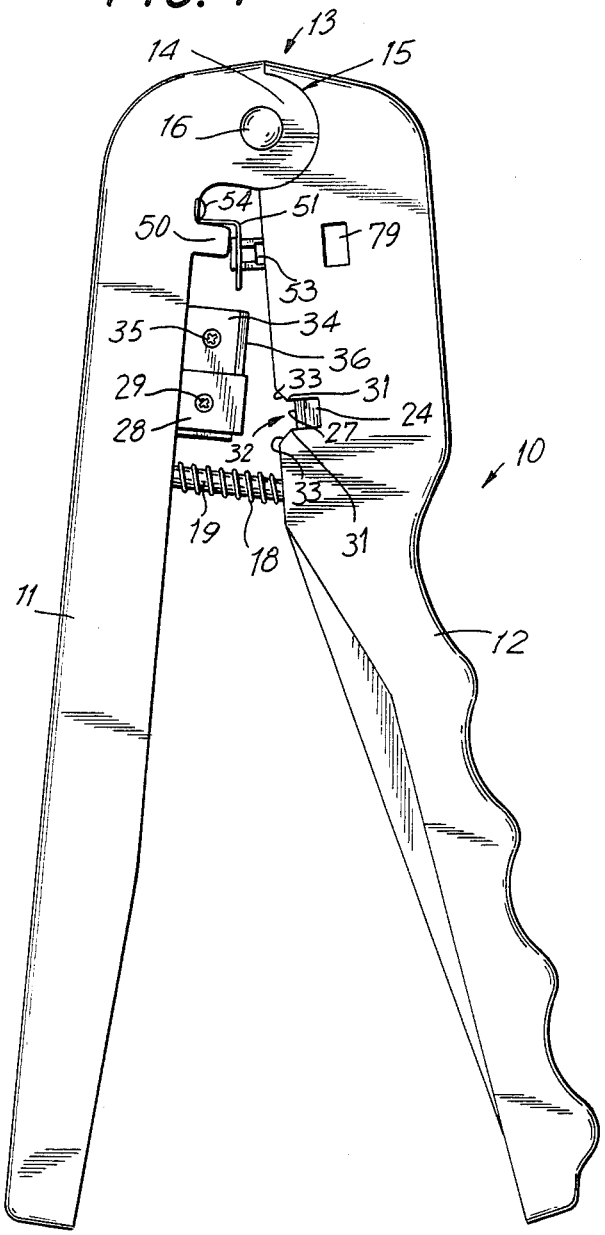
FIG. 5
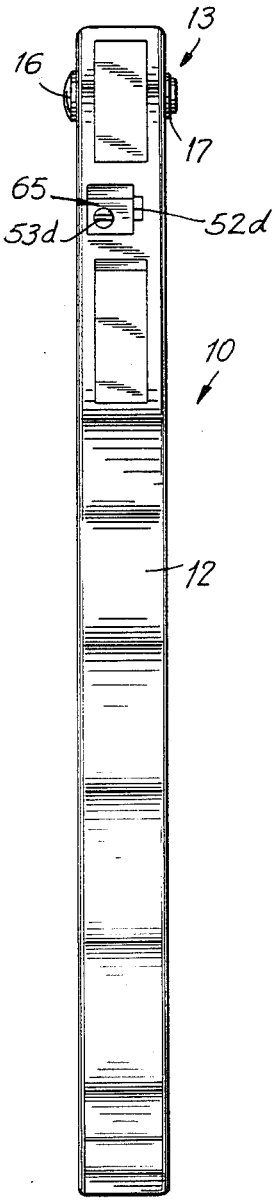
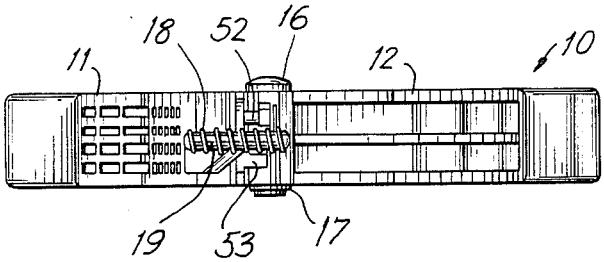
FIG. 6

FIG. 14
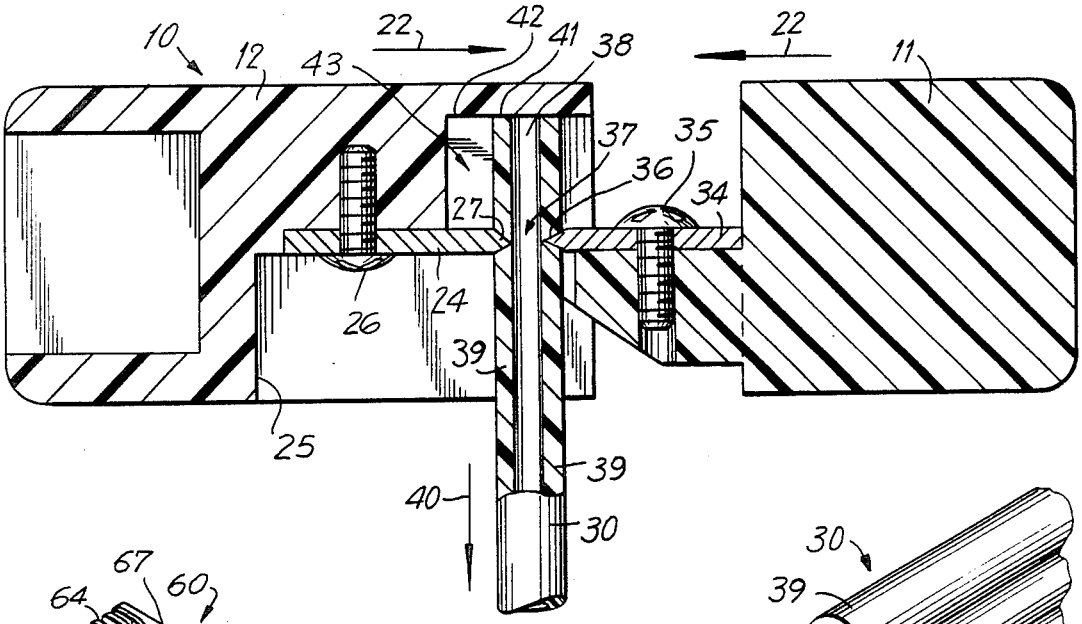
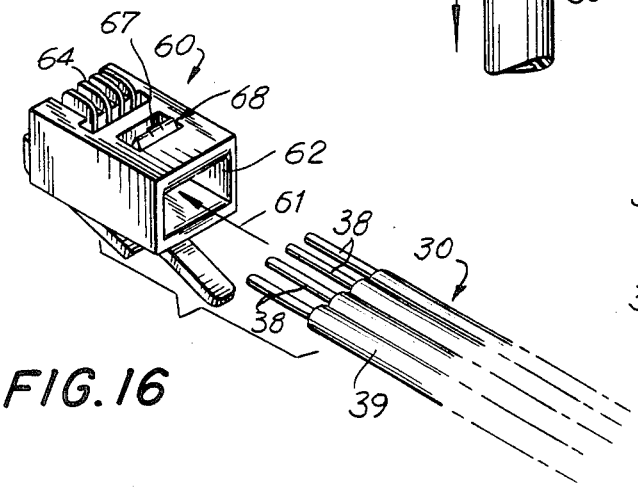
FIG. 16
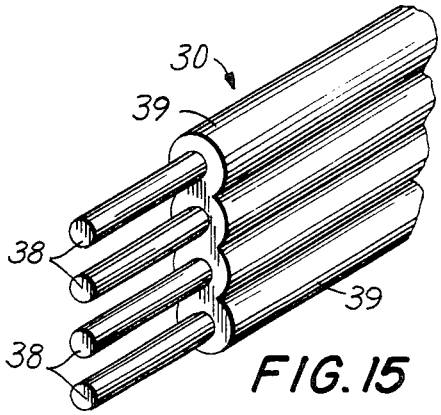
FIG. 15
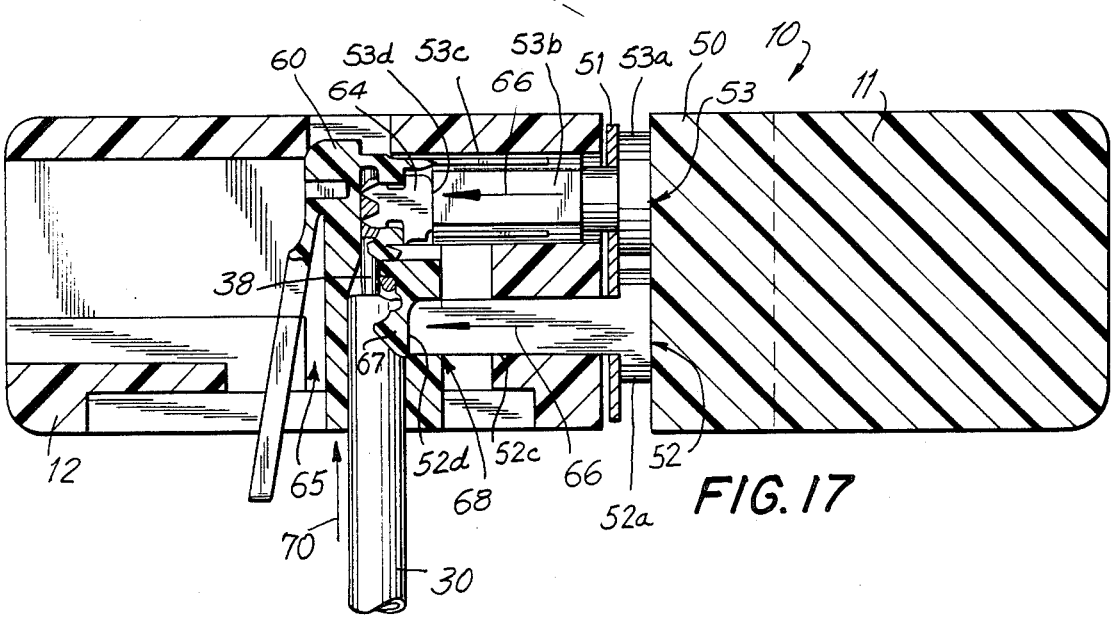
FIG. 17

TELEPHONE WIRE-AND-JACK ATTACHMENT DEVICE AND KIT

Cross-Reference to Related Applications

This application is a continuation of patent application Ser. No. 780,760, filed Sept. 27, 1985, now abandoned.

FIELD OF THE INVENTION

The invention pertains to telephone wire-cutting tools, and more particularly to a device for attaching and electrically connecting a jack to a telephone wire.

BACKGROUND OF THE INVENTION

In recent times, organizations and individuals are installing their own telephones and other telecommunication equipment. Many of these telephones use a modular jack connector for easy installation. These modular jack connectors snap into wall outlets and the telephone base units. the telephone wires having these modular connectors come in standard lengths and can be purchased in most hardware and merchandising establishments.

In some instances, people desired longer cord lengths. Purchase of telephone wire of long length was possible, but until now, there was no commercially available tool for attaching the modular jack connectors to the wire.

The present invention features a kit having a quantity of modular jack connectors and a tool that cuts and strips the insulation from a telephone wire. A pair of crimping hammers are disposed on the tool for attaching and electrically connecting the modular jack connectors to a cut and stripped telephone wire.

With the above kit, organizations and individuals can now construct telephone wires of any desired length having a modular jack connector on each end for quick attachment to outlets and equipment.

BRIEF SUMMARY OF THE INVENTION

This invention relates to a kit and device for mechanically attaching and electrically connecting modular jack connectors to a telephone wire.

The kit features a hand-held tool having means for cutting and stripping telephone wire as well as mechanically attaching and electrically connecting jack connectors to the cut and stripped wire.

A package for housing the aforementioned tool is provided in the kit, as well as a quantity of jack connectors having terminals for connecting to the color coded telephone wire.

The tool comprises a pair of first and second jaw members that are pivotable at a top portion. The jaw members resemble a nut-cracker or plier-type device. The jaw members are gripped in one hand of a user and squeezed to perform the necessary cutting, stripping and crimping operations. Two operating positions are defined: an open gripped position and a closed (squeezed) position.

The jaw members have cutting members adjacently disposed thereon, for cutting and stripping telephone wire, when the telephone wire is inserted therebetween and the jaw members are moved from the open to the closed position.

The tool also has a contoured aperture means for placing a jack connector in one of the jaw members.

The placed connector contains the cut and stripped wire.

The other jaw member has means for attaching and electrically connecting the cut and stripped wire to the jack connector, when the jaw members are moved to the closed position. The attaching and connecting means includes a pair of adjacently disposed crimping hammers. One of the hammers forces an attaching finger into engagement with the wire from said jack connector. The other hammer contacts electrical terminals in the jack connector and forces them to penetrate the telephone wire, thus creating an electrical connection. Both hammers are actuated when the jaw members are squeezed to the closed position.

A spring disposed between the jaw members biases them towards the open position. A rod disposed between the jaw members limits the travel of the members towards the closed position.

One of the jaw members has a contoured surface for placement of the fingers of the user's hand. This contour facilitates the gripping of the tool by the fingers of the hand.

It is an object of the invention to provide an improved tool or kit for attaching and electrically connecting a modular jack connector to a telephone wire.

It is another object of the invention to provide a tool or kit that cuts, strips, mechanically attaches and electrically connects a telephone wire to a modular jack connector.

These and other objects of the invention will be better understood and become more apparent with reference to the subsequent detailed description considered in conjunction with the accompanying drawings.

BRIEF DESCRIPTION OF THE DRAWINGS

FIG. 4, is a back view of the tool depicted in FIGS. 1 and 2;

FIG. 5 is a left side view of the tool depicted in FIGS. 1 and 2;

FIG. 6 is a bottom view of the tool shown in FIG. 4;

FIG. 14 is a sectional view of a telephone wire being stripped of insulation in the tool depicted in FIG. 12, taken along line 14—14;

FIG. 15 is a perspective view of the cut and stripped telephone wire shown in FIGS. 13 and 14;

FIG. 16 is a perspective view of the cut and stripped wire of FIG. 15 being inserted into a modular jack connector, which is subsequently inserted into a crimping recess of the tool shown in FIG. 2;

FIG. 17 is a sectional view of the tool illustrated in FIG. 12, taken along line 17—17, depicting the crimping hammers attaching and connecting the telephone wire to the modular jack connector placed in the contoured aperture of the jaw member of the tool.

DETAILED DESCRIPTION OF THE INVENTION

Generally speaking, the invention features a kit containing a hand-held tool for cutting and stripping telephone wire and then mechanically attaching and electrically connecting the stripped wire to a modular jack connector by crimping elements of the jack into engagement with the wire.

For the purpose of clarity and brevity, like elements will have the same designation throughout the Figures.

Figure 1:
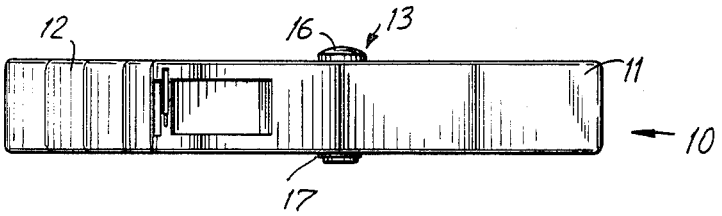
FIG. 1 is a top view of the tool of this invention for cutting, stripping, mechanically attaching, and electrically connecting telephone wire to a modular jack connector.

Referring now to FIGS. 1≠6, a tool 10 is shown, which can cut, strip, attach, and electrically connect a telephone wire to a modular jack connector.

The tool 10 comprises two jaw members 11 and 12, respectively. The jaw members 11 and 12 are pivotably connected at a top pivot portion 13. Jaw member 11 has two convex, semi-circular cams 14 that pivot in the correspondingly contoured, concave surface 15 of jaw member 12, as shown in FIGS. 1, 4, 8 and 9. An interlocking cam 15*a* is disposed between cams 14.

As illustrated in FIGS. 1–6, a pin 16 extends through the pivot portion 13 to secure the cams 14 and 15*a* of jaw members 11 and 12 to each other in pivotable engagement. A C-ring washer 17 laterally secures the pin 16.

Figure 2:
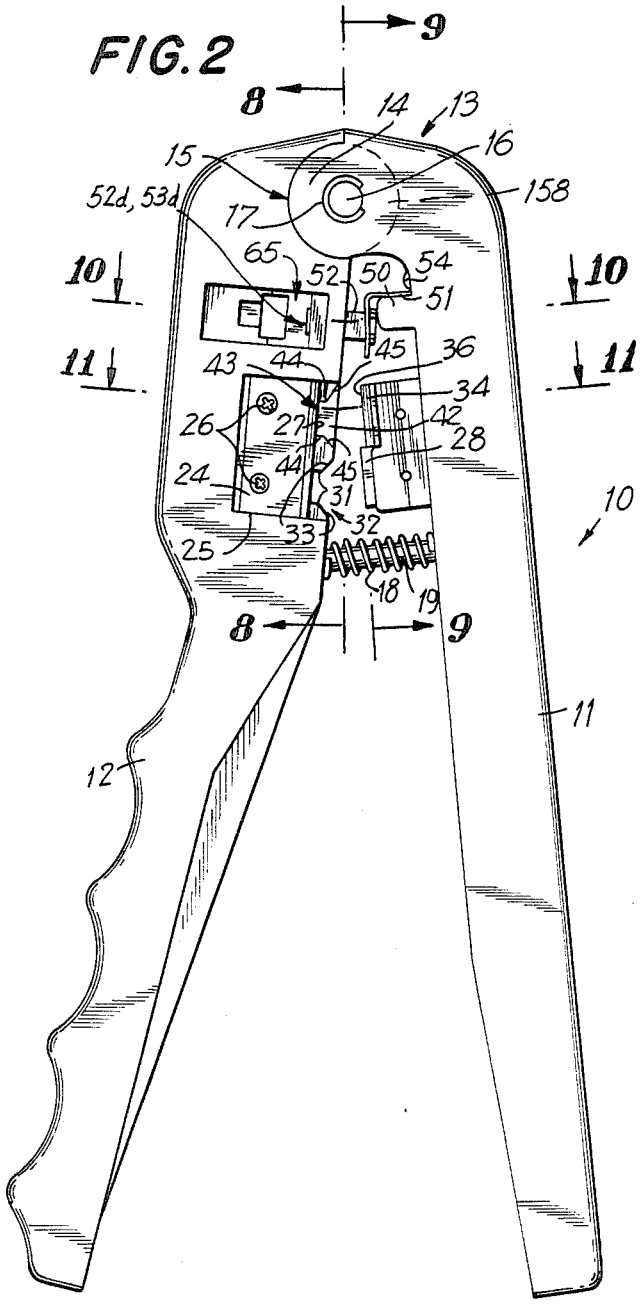
FIG. 2 is a front view of the tool of FIG. 1, shown in an open position.
Figure 3:
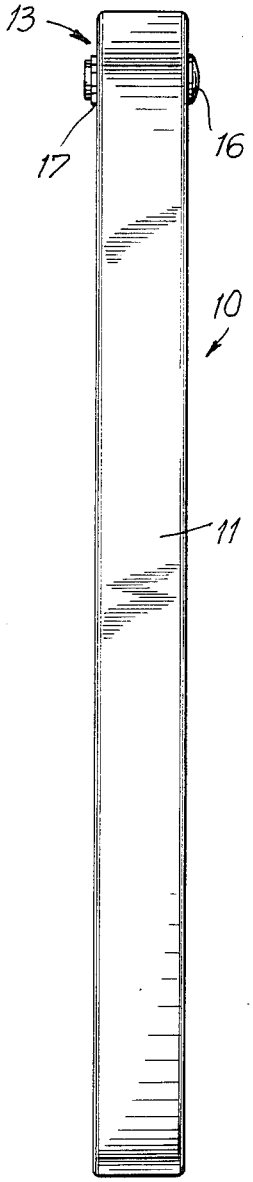
FIG. 3 is a right side view of the tool illustrated in FIGS. 1 and 2.
Figure 12:
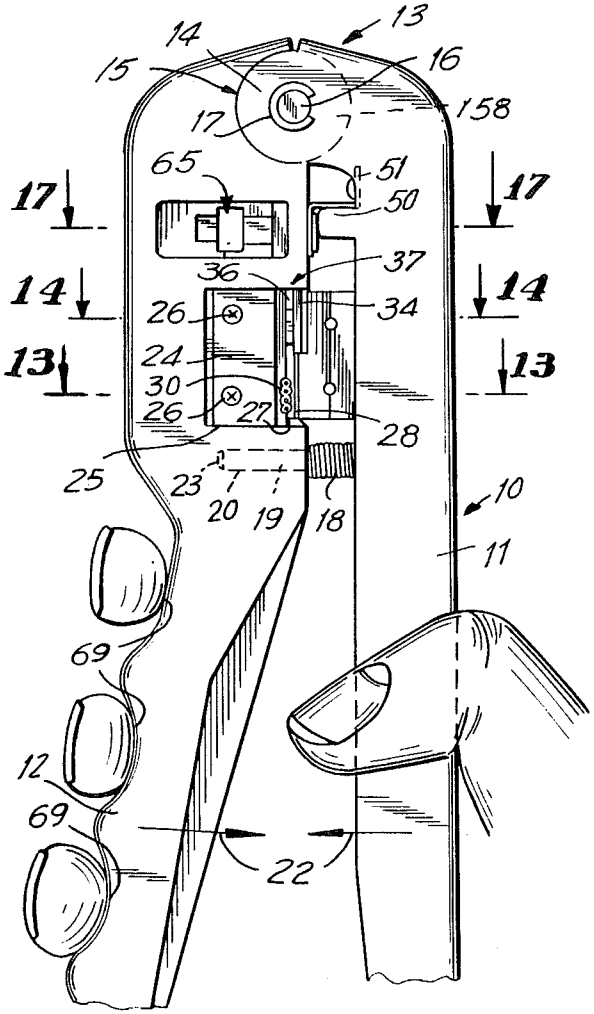
FIG. 12 is a perspective view of the tool of this invention being squeezed towards its closed position by a human hand.

The jaw members are movable between the open, unsqueezed position shown in FIGS. 2 and 4, and a squeezed, closed position illustrated in FIG. 12.

Figure 11:
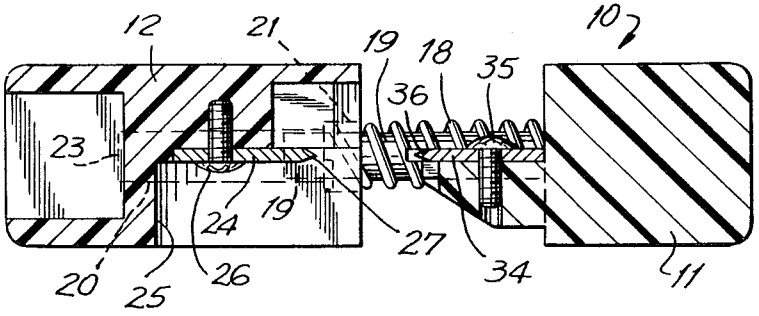
FIG. 11 is a sectional view of the tool of FIG. 2 shown along line 11—11.
Figure 9:
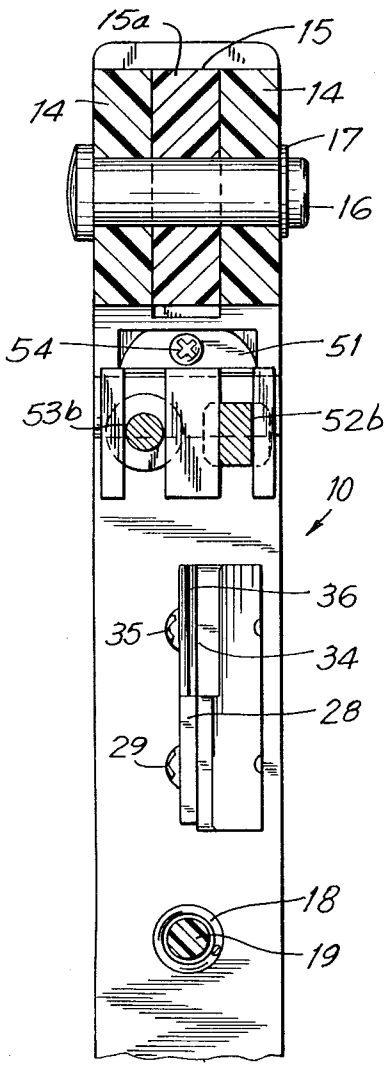
FIG. 9 is a sectional view of the tool shown in FIG. 2, taken along line 9—9.
Figure 8:
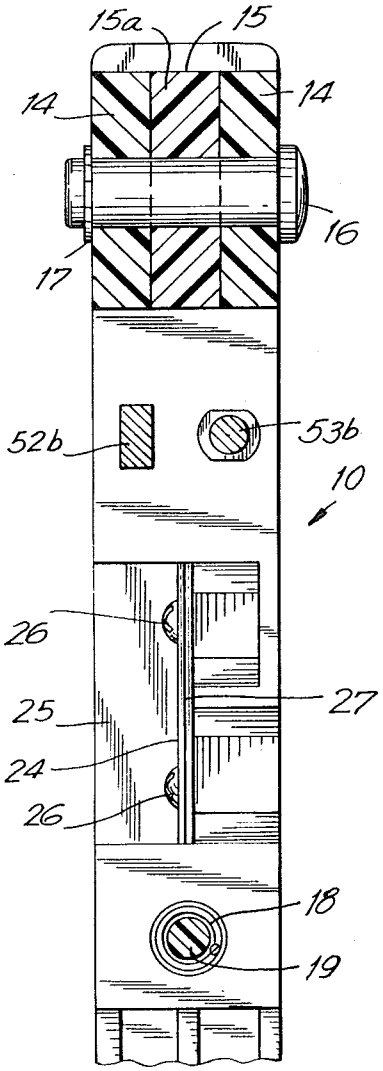
FIG. 8 is a sectional view of the tool illustrated in FIG. 2, taken along line 8—8.

A coil spring 18 disposed between the jaw members 11 and 12, baises the jaw members to the open position. The spring is guided by a rod 19 disposed within the coil. The rod 19 is affixed to jaw member 11 and is slidably disposed within bore 20 of the jaw member 12, as best seen in FIG. 11. A counter-bore 21, prevents movement of the spring 18.

When the jaw members are squeezed (arrows 22; FIG. 12) towards the closed position, the coil spring 18 compressed, as shown in FIG. 12. The movement (arrows 22) of the jaw members 11 and 12 towards the closed position is limited by the travel of rod 19 in bore 20, i.e. the end face 23 of bore 20 acts as a limiting stop to the movement of rod 19, and hence the squeezing movement (arrows 22) of the jaw members 11 and 12.

The jaw member 12 has a knife blade 24 disposed in a recessed well 25. The blade 24 is secured to the jaw member 12 by two screws 26, as best seen in FIGS. 2, 8, 11 and 14. The cutting edge 27 of the knife blade 24 abuts against a flat surface plate 28 affixed to jaw member 11 by screw 29, when the jaw members are squeezed to the closed position, as shown in FIG. 12.

Figure 13:
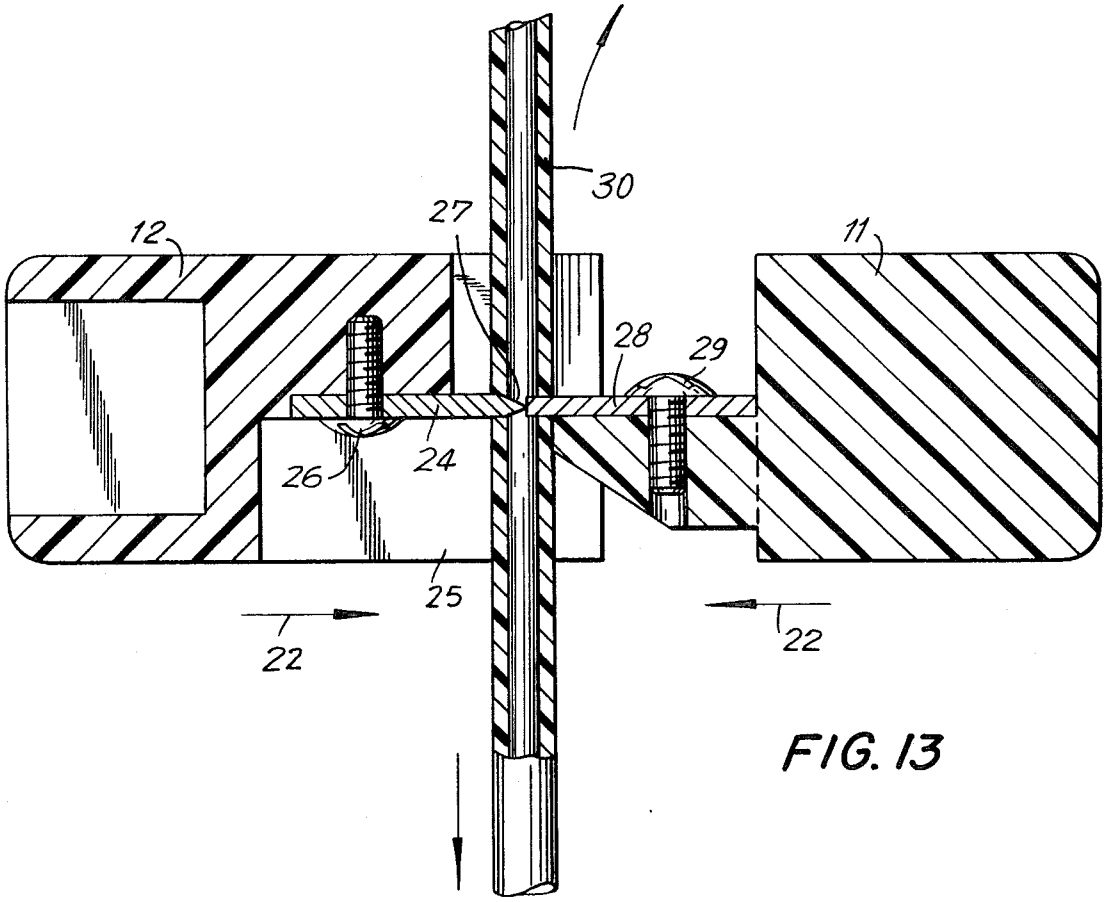
FIG. 13 is a sectional view of a telephone wire being cut in the tool illustrated in FIG. 12, taken along line 13—13.

A telephone wire 30 placed between the flat surfaced plate 88 and the sharp cutting edge 27 of blade 24, will be caused to be severed, when the jaw members are squeezed (arrows 22), as depicted in FIGS. 12 and 13. A square cut in the telephone wire 30 is achieved by molded recess 32 defined by guide walls 31, which hold the wire 30 in a perpendicular orientation with respect to blade 24 and flat plate 28, as illustrated in FIGS. 2, 4 and 13. The walls 31 are prefaced by chamfered surfaces 33, which guide the telephone wire 30 into proper orientation with recess 32.

The square cut in the telephone wire 30 is essential in providing the proper attachment of the wire to the modular jack connector, as will be explained in more detail hereinafter.

The cutting edge 27 of blade 24 comes into adjacent relationship with another cutting edge 36 of knife blade 34 affixed to jaw member 11 by screw 35, as best seen in FIGS. 12 and 14. The cutting edges 27 and 36 are separated by a small gap 37 in the closed position, equivalent to the diameter of the conductors 38 of the telephone wire 30. Blades 24 and 34 cut into the insulation 39 of the wire 30, but not the conductors 38, when the jaw members 11 and 12 are squeezed (arrows 22) to the closed position, as depicted in FIGS. 12 and 14. The insulation 39 is severed, and then stripped (arrow 40) from the wire 30, leaving the exposed conductors 38, as shown in FIG. 15.

The insulation 39 is stripped from the wire 30 by pulling (arrow 40) the wire 30 from the tool 10, after the blades 24 and 34 have cut into the insulation 39, as shown in FIG. 14.

The perpendicular cut in the wire made by blade 24 and flat plate 28, assists in making a clean stripping of the insulation 39 from wire 30. The square edge 41 (FIG. 14) of the cut wire 30 is abutted against flat surface 42 of recess 43 in jaw member 12 prior to cutting the insulation 39 of wire 30. This insures a normal cut of the insulation, i.e. perpendicular to the length of wire 30.

The wire 30 is placed in recess 43, and held therein in proper orientation by walls 44, that define recess 33, as depicted in FIG. 2.

The chamfered surfaces 45 assist in placing the wire 30 into recess 43 with the proper orientation to provide a square severance of the insulation 39 from wire 30.

The proper stripping cut is necessary to achieve a good electrical connection to the modular jack connectors, as will be described hereinafter.

The jaw member 11 has abutting surface 50 about which is disposed a Z-shaped clip 51, that holds two crimping hammers 52 and 53, as illustrated in FIGS. 2, 4–6, 8–10 and 17. The heads 52*a* and 53*a* of the hammers abut against the abutment 50, while the hammer shanks 52*b* and 53*b* project through clip 51, as best seen in FIG. 17.

The clip 51 is secured to jaw member 11 by screw 54.

The hammer shanks 52*b* and 53*b* slide in bores 52*c* and 53*c*, respectively disposed in jaw member 12.

Figure 7:
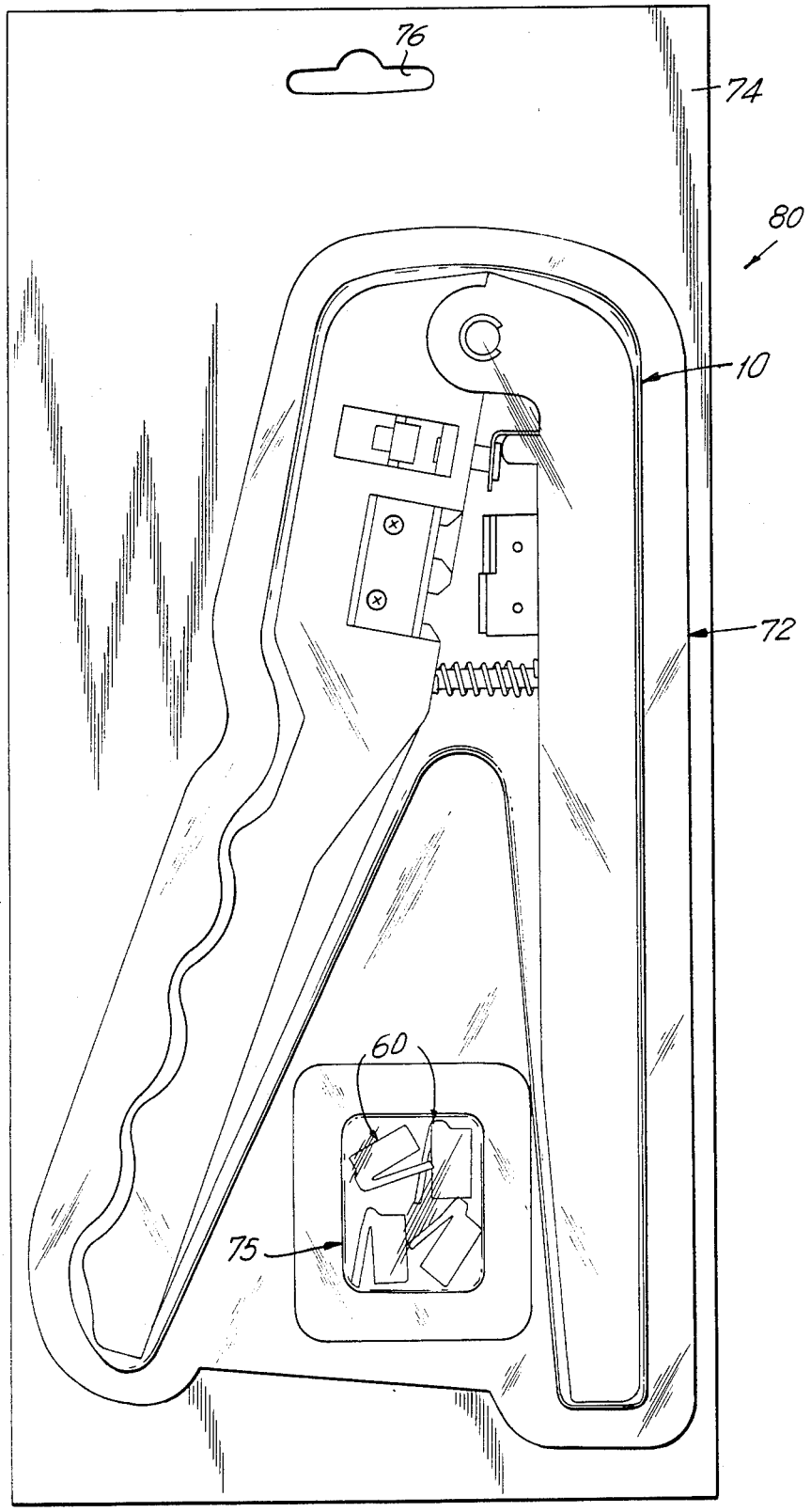
FIG. 7 is a plan view of a kit housing the tool shown in FIGS. 1 and 2.
Figure 10:
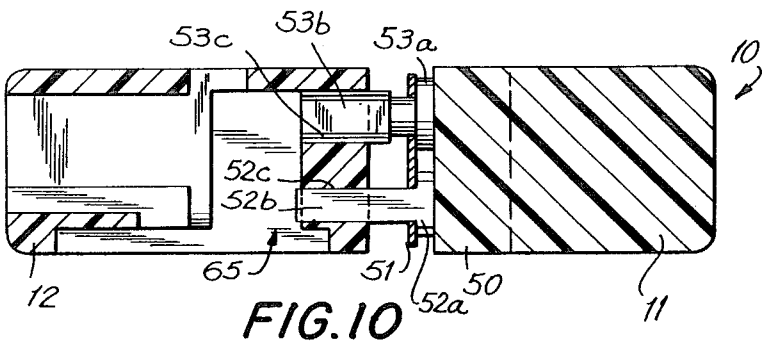
FIG. 10 is a sectional view of the tool of FIG. 2 depicted along line 10—10.

The cut and stripped telephone wire 30 of FIG. 15 is mechanically attached and electrically connected to a modular jack connector 60, shown in FIGS. 7, 16 and 17, by first placing the stripped conductors 38 of wire 30 into (arrow 61) the recess 62 of the connector 60 as illustrated in FIG. 16. The conductors 38 of wire 30 should be inserted so that they are opposite the electrical terminal teeth 64 of the connector 60.

The four conductors 38 of wire 30 should align with the four teeth 64 of modular jack connector 60.

The modular jack connector 60 is then inserted (arrow 70) into a contoured recess 65 of jaw member 12, as best seen in FIGS. 2, 12 and 17.

The bores 52*c* and 53*c* that slidably support (arrows 66) the hammer shanks 52*b* and 53*b*, respectively, enter into the connector recess 65, such that the respective faces 52*d* and 53*d* of the hammers come into contact with the connector 60 disposed therein, when the jaw members are squeezed to the closed position. This can best be seen with reference to FIGS. 10 and 17.

The hammer face 52*d* has a flat surface that pushes against the locking finger 67 in recess 68 of the connector 60, as depicted in FIGS. 16 and 17, when the hammer 52 is caused to move (arrow 66) into recess 65.

The locking finger 67 mechanically attaches the connector 60 to wire 30, by crimping the finger 67 into locking engagement with the wire 30, as shown in FIG. 17. This mechanical crimp will prevent the wire 30 from being removed from the modular jack connector 60.

The hammer face 53*d* has four projections, as best seen in FIG. 5. These projections are caused to align with the four terminal teeth 64 of the connector 60, when the hammer 53 is moved (arrow 66) into recess 65. The hammer 53 causes the metal teeth 64 of the connector 60 disposed in recess 65 to bite into respective stripped conductors 38 of wire 30, as depicted in FIG. 17.

Thus, each conductor 38 of wire 30 is electrically connected to a respective terminal of the connector 60.

The above tool 10 can be packaged as a kit 80, shown in FIG. 7.

The kit 80 comprises a quantity of modular jack connectors 60 disposed in a well 75, which forms part of the bubble plastic container 72, that also surrounds the tool 10. The bubble plastic container 72 is bonded to a cardboard backing 74 that also has printed matter thereon in the form of advertising, and instructions in the use of tool 10.

The backing 74 can have a slot 76 at the top thereof, for hanging display on store display rods, or on hooks in workshops.

Many modifications can be made in the tool 10, as befits the practitioner of the art. For example, jaw member 12 can be molded to have finger contours 69 to provide easy gripping by the fingers of a hand, as illustrated in FIG. 12.

A window 79 (FIG. 4) can be provided at the back of recess 65, for removing connectors 60 that may get jammed in the recess 65, when too much crimping force is applied.

The tool 10 can be molded of styrene or cycolac plastics. Any high impact type plastic is acceptable.

Having this described the invention, what is desired to be protected by Letters Patent, is presented in the subsequently appended claims.

What is claimed is:

1. A hand-held tool for cutting and stripping a telephone wire and attaching and electrically connecting jack connectors to said telephone wire, said hand-held tool comprising:

a first hand-held jaw member, a second hand-held jaw member cooperating with said first hand-held jaw member and pivotably attached thereto at a top portion thereof, said jaw members cooperating with each other to define hand gripped open and closed positions, cooperating cutting members adjacently disposed upon said first and second jaw members for cutting and stripping telephone wire, when said telephone wire is inserted between said cutting members and when said jaw members are moved from said open to said closed position, a contoured aperture having a jack connector shape, disposed upon said first jaw member for placement of a jack connector containing said cut and stripped telephone wire, and means disposed upon said second jaw member for attaching and electrically connecting said telephone wire to said jack connector placed in said first jaw member, when said jaw members are moved from said open to said closed position, and said cooperating cutting members comprising;

a unitary knife blade having a straight cutting edge, mounted on said first jaw member, a flat surface on said second jaw member for cooperating with the cutting edge of said unitary knife blade when moving from the said open to closed position, for severing a wire by cutting it through, a pair of wall surfaces in said first jaw member, perpendicular to said knife blade, defining a recess extending below the said cutting edge, for holding the wire perpendicular to the unitary blade for effecting a square cut of the wire by the blade and flat surface, and a knife blade, mounted on said second jaw member, a second pair of wall surfaces in said first jaw member perpendicular to said knife blade, and a wall surface perpendicular to said second pair, defining a recess for holding the wire perpendicular to the unitary blade for effecting a square cut of the wire by the blade and flat surface, said straight cutting edge and said second jaw member blades' cutting edges are opposed for cutting into said wire when moved from the said open to closed positon, and a rod, mounted on a bottom portion of one of the jaw members, distal from the unitary blade and from the jack connector placement means, and a mating face on the other jaw member for establishing a controlled gap between said straight cutting edge and said second jaw member blade's cutting edge when they are moved from the said open to closed position.

2. The hand-held tool of claim 1, further comprising:

said means for attaching and electrically connecting said telephone wire to said jack connector comprising a pair of crimping hammers extending into said first jaw member and held on said second jaw member opposite said contoured aperture of said first jaw member by a clip on said second jaw member, said clip engaging each hammer so that they are drawn back by the second jaw member, from an extended position in the first member to a less extended postion, when the members are moved from the closed to open postion, said crimping hammers including a first hammer for mechanically forcing an attaching connector finger into engagement with said wire, and a second hammer for contact with electrical teeth terminals disposed in said jack connector, said second hammer forcing said electrical terminals of said jack connector to penetrate said telephone wire and become electrically connected thereto, when said jaw members are moved from said open to said closed position, said clip is oriented so that it will not prevent contact of the rod and its mating face when the jaw members are moved to the said closed postion.

3. The hand-held tool of claim 1, wherein said tool is housed in a package to form a kit.

4. The hand-held tool of claim 1 or 2, wherein said jaw members are pivotably connected at a top portion thereof by interlocking cam means for limiting said open position.

5. The hand-held tool of claim 4, further comprising a coil spring positioned about said rod for urging the jaw members from said closed position towards said open position.

* * * * *